United States Patent [19]

Adler

[11] 4,413,757

[45] Nov. 8, 1983

[54] DISPENSER FOR REPELLING ANIMALS

[76] Inventor: Harold A. Adler, 1457 Eastwind Cir., Westlake Village, Calif. 91361

[21] Appl. No.: 242,039

[22] Filed: Mar. 9, 1981

[51] Int. Cl.[3] ..... B65D 1/32

[52] U.S. Cl. ..... 222/105; 222/183; 222/212; 222/482

[58] Field of Search ..... 222/92, 95, 96, 105, 222/107, 183, 206, 212, 214, 215, 251, 386.5, 481, 542, 482; 251/8

[56] References Cited

U.S. PATENT DOCUMENTS

| | | | |
|---|---|---|---|
| 715,429 | 12/1902 | Seabury | 251/8 |
| 1,619,120 | 3/1927 | Heaton | 222/105 |
| 2,720,998 | 10/1955 | Potter | 222/105 |
| 3,380,631 | 4/1968 | Perrinjaquet | 222/96 |
| 4,067,499 | 1/1978 | Cohen | 222/105 X |
| 4,098,434 | 7/1978 | Uhlig | 222/95 |
| 4,177,939 | 12/1979 | Thomas | 222/214 X |

*Primary Examiner*—F. J. Bartuska

[57] ABSTRACT

A pungent liquid dispensing apparatus for repelling animals, such as dogs, which comprises a pair of connected housing sections forming an enlarged internal chamber. Within the internal chamber is to be located a flexible walled bladder. Within the bladder is to be located a quantity of the pungent liquid. Compressing movement of the pair of housing sections results in discharging of a stream of the pungent liquid through an outlet valve assembly. An appropriate inlet valve assembly is mounted within one of the housing sections to provide for resupply of the pungent liquid within the bladder.

1 Claim, 5 Drawing Figures

DISPENSER FOR REPELLING ANIMALS

BACKGROUND OF THE INVENTION

The field of this invention relates to dispensing apparatuses, and more particularly to a liquid dispenser which can be readily carried within the hand of a person to be utilized primarily to repel animals, such as dogs.

At the present time, a common activity of a great number of people is jogging. Most joggers are forced to run on streets and sidewalks, which takes the jogger into residential areas. Quite often residences have a domesticated animal, such as a dog. It is not at all uncommon for the dog to be overly protective of his property and to come running at the jogger, sometimes even biting the jogger. Of course, this is most undesirable, not only from the jogger's point of view, but also because of the problems which will occur with the owner of the dog regarding liability resulting from injury to the jogger.

It would be desirable to employ some means to quickly repel the dog at a distance without causing injury to the dog. The animal should quickly associate the foul odored liquid with its source to thereby abort any desire for the attack. It would be further desirable that this means could be readily carried the jogger, would be light in weight and would not interfere with the running of the jogger. Prior to the present invention, there has been no known apparatus which has been specifically designed to be carried by a jogger for the repelling of a possible attack by a dog.

SUMMARY OF THE INVENTION

The structure of this invention relates to a dispenser which takes the form of a pair of telescopingly connected together housing sections. Within the pair of housing sections is an enlarged internal chamber. Within this internal chamber is located a flexible walled bladder. Within the bladder is to be located a relatively harmless liquid, such as ammonia and water. Movement of one of the housing sections with respect to the other housing section is to cause compressing of the bladder resulting in the discharge of a stream of liquid through an orifice mounted within an outlet valve assembly. The outlet valve assembly is mounted within one of the housing sections. A closable inlet valve assembly to facilitate the resupply of liquid to the bladder is also connected in one of the bladder sections.

The primary objective of this invention is to construct a dispensing device which is to be readily carryable by an individual and is to be utilized to effect discharge of a stream of pungent liquid for repelling the attack by a dog to prevent injury to the individual by the dog.

Another objective of this invention is to construct an animal repelling apparatus which is constructed of few parts and can be manufactured relatively inexpensively.

DETAILED DESCRIPTION OF THE SHOWN EMBODIMENT

Figure 1:
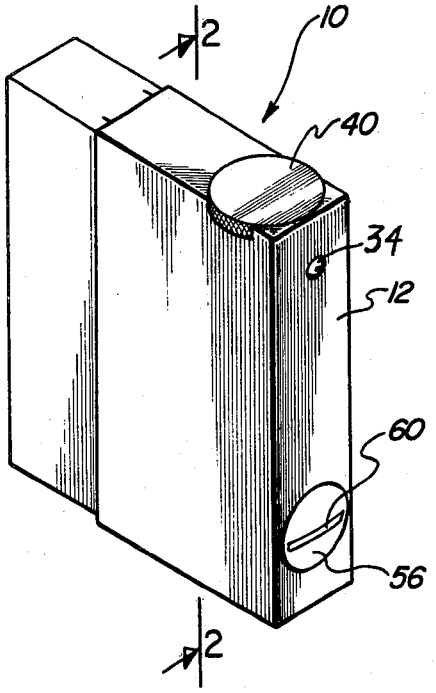
FIG. 1 is an exterior, isometric view of the dispenser of this invention.

Referring particularly to the drawing, there is shown in FIG. 1 the dispenser 10 of this invention which is composed generally of a first housing section 12 and a second housing section 14. Both the housing sections 12 and 14 are box-like in configuration with housing section 12 having a first internal chamber 16 and housing section 14 having a second internal chamber 18. The internal chambers 16 and 18 cooperate together to form a single enlarged internal chamber. Basically, the material of construction of the housing sections 12 and 14 is of sheet material, such as plastic or metal.

The housing section 12 is open ended and adjacent the open end thereof is formed a pair of spaced-apart pawls 20 and 22. Pawl 20 is mounted on one sidewall of the housing section 12, with the other pawl 22 mounted on the opposite sidewall of the housing section 12.

Figure 2:
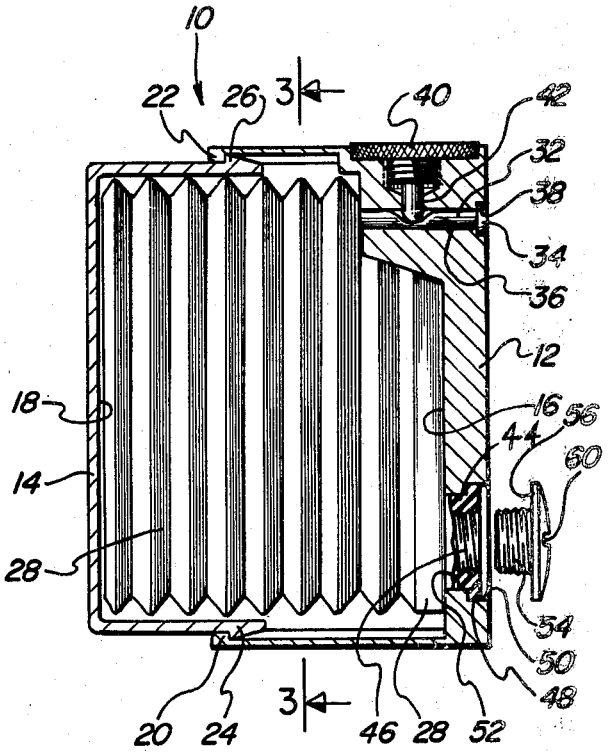
FIG. 2 is a cross-sectional view of the dispenser of this invention taken along line 2—2 of FIG. 1.
Figure 3:
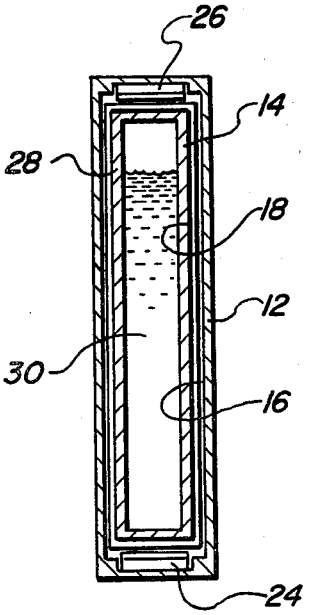
FIG. 3 is a cross-sectional view through the dispenser of this invention taken along line 3—3 of FIG. 2.
Figure 4:
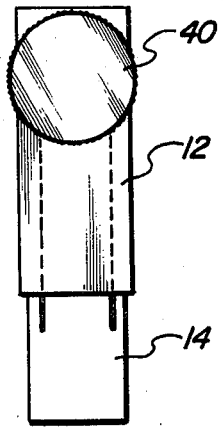
FIG. 4 is a top view of the dispenser of this invention.
Figure 5:
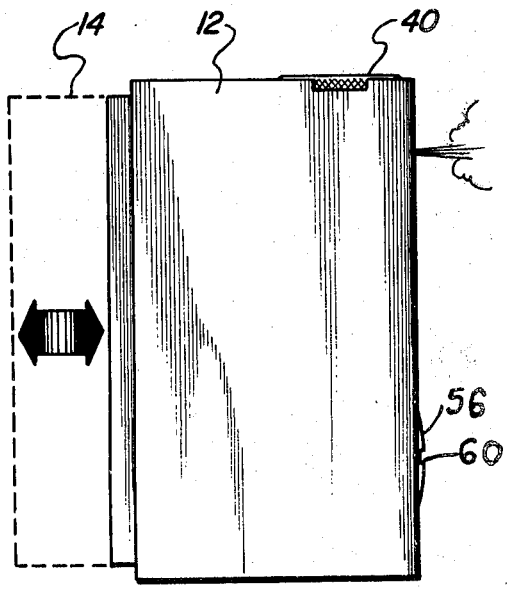
FIG. 5 is a side view of the dispenser of this invention showing the movement of the dispenser to effect the dispensing of the liquid contained within the dispenser.

Similar pawls 24 and 26 are formed within opposite sidewalls of the housing section 14. It is to be noted that the forward edges of the pawls 24 and 26 are inclined forming cam surfaces. When putting together housing sections 12 and 14 as shown in the drawing, the cam surfaces of the pawls 24 and 26 are to contact the respective pawls 20 and 22 with such riding up the cam surfaces until the pawls 24 and 26 are located inwardly of the pawls 20 and 22 as shown in FIG. 2 of the drawing. The pawls 20 and 22 then function as a stop means to limit the outward movement of the housing section 14 with respect to the housing section 12. If it is ever necessary to disassociate the housing sections 12 and 14, it is only required that the individual manually squeeze together the side walls of the housing section 14 in an inward direction to disengage the pawls 24 and 26 from the pawls 20 and 22. Housing section 14 can then be removed from housing section 12.

Located within the single enlarged chamber is a bladder 28. The bladder 28 will be formed of a flexible walled material, such as rubber, or plastic. Also, the bladder 28 is shown to have a series of corrugations which causes the bladder to function somewhat as a spring. The normal at rest position of the bladder 28 is in its expanded state with the housing sections 12 and 14 as shown in FIG. 2 of the drawing. The reason for this is to keep the dispenser apparatus 10 of this invention in a "ready to use" position prior to use.

Within the bladder 28 there is to be located a quantity of a pungent liquid 30. An example of a pungent liquid would be ammonia and water. However, it is considered to be within the scope of this invention that any pungent liquid could be employed as long as it is not too viscous.

Attached to the bladder 28 is an outlet tube 32. The outlet tube 32 is also formed of the same material of construction as the bladder 28. The outlet tube 32 has an enlarged outer end 34. The outlet tube 32 is located in a close fitting manner within an opening 36 formed within the housing section 12. The enlarged end 34 rests within an enlarged annular recess 38 formed within the outer wall of the housing 12. The enlarged end 34 is located within the recess 38 to prevent retraction of the outlet tube 32. The function of the outlet tube 32 is to provide for discharge of the liquid 30 into the ambient.

Rotatably mounted within the housing section 12 is a knob 40. The knob 40 is mounted substantially flush with the sidewall of the housing section 12 and is of a diameter to slightly protrude beyond each sidewall of the housing section 12. This protrusion is to facilitate manual turning of the knob 40. The knob 40 is threadably mounted within the housing section 12 and includes an inner protruding end 42. This inner protruding end 42 is to press against the outlet tube 32. Rotating of the knob 40 to push the protruding end 42 to move the protruding end 42 to compress the outlet tube 32 will result in closing of the inlet tube 32 and prevent leakage of liquid therefrom. This will be the non-use position for the knob 40.

Integrally attached to the bladder 28 is an inlet conduit 44. This inlet conduit 44 includes a series of internal screw threads 46. The outer lip of the conduit 44 includes an enlarged annular shoulder 48. This enlarged annular shoulder 48 rests within an annular recess 50 located at the outermost end of an opening 52. Again, the shoulder 48 connecting with the recess 50 prevents retraction of the conduit 44 to within the chamber 16.

A plug 54 is provided which has an enlarged outer head 56 and a tapered threaded end. The tapered threaded end 58 is to threadingly connect with the screw threads 46. The outer surface of the enlarged head 56 includes a slot 60 to facilitate connection with a tool for the purpose of tightening the plug 54. Tightening of the plug 54 causes the conduit 44 to be tightly pushed against the sidewall of the opening 52 effectively closing of the conduit 44 to prevent leakage of liquid therethrough. When it is desired to supply liquid 30 to within the bladder 28, it is necessary to remove the plug 54. Upon the bladder 28 being filled, the plug 54 is then replaced and tightened to prevent leakage of liquid from the conduit 44.

The operation of the dispenser of this invention is as follows: Assuming that the bladder 28 has been previously filled with the liquid 30 and the knob 40 has been turned to close the outlet tube 32, discharge of any liquid from the dispenser is prevented at this time. In order to operate the dispenser 10 of this invention, the operator must first rotate the knob 40 a small amount, such as one half a revolution or one revolution. The operator will quickly learn by experience exactly how much he wishes to turn the knob 40. A restricted orfice is then formed within the outlet tube 32 and upon squeezing of the sections 12 and 14 to cause movement of the housing section 14 and compressing of the bladder 28, the liquid 30 will be discharged through the outlet tube 32. Turning of the knob 40 only one half a turn will result in a finer stream which can be discharged a greater distance than when the knob 40 is turned a complete revolution. When the knob is turned one whole revolution, a greater volume of liquid 30 is discharged through the outlet tube 32. The greater volume would normally be used at a short range, with the thinner discharge stream being employed at a longer range.

The discharge stream of liquid is to be directed either in front of the animal, or at the animal's eyes. In most instances, the mere presence of the pungent odor of the liquid 30 in close proximity to the animal will repel the animal. However, if the animal is not repelled, at this time, the operator is to direct the stream of the discharged liquid directly into the animal's eyes, causing a minor burning sensation. This should make the animal quickly retreat.

It is to be understood that the adjustment of the knob 40 can vary the discharge from a stream to a spray. With the knob 40 tightened, the dispenser cannot leak. Also, the dispenser of the invention could be utilized for personal protection against human beings. Because of the dispenser's size and shape, it can be innocuously and conveniently carried in a pocket or purse. The liquid to be used is a readily available, inexpensive household liquid.

What is claimed is:

1. A hand held dispenser for a pungent liquid to repel animals comprising:

a first housing section having a first internal chamber;

a second housing section having a second internal chamber and an end wall, said first and said second housing sections being telescopingly connected together so said first and second internal chambers cooperate together to form a single enlarged chamber, said second housing section being telescopingly movable with respect to said first housing section by squeezing said end wall toward said first housing section so as to forcefully rapidly and sharply reduce the volume of said single enlarged chamber;

an outlet valve assembly attached to said first housing section, said outlet valve assembly to be capable of dispensing a directed stream of liquid;

a bladder adapted to contain an animal-repelling pungent liquid, said bladder being located within and substantially filling said single enlarged chamber, said bladder having a liquid inlet and a liquid outlet, said liquid outlet connecting with said outlet valve assembly, whereby upon moving of said second housing section relative to said first housing section decreasing the volume of said single enlarged chamber the said bladder is compressed causing discharge of liquid from said bladder through said outlet valve assembly, said bladder having a bottom end directly bearing against said end wall and being completely corrugated on its sides so that, when collapsed by said squeezing action, said bladder is substantially emptied of said liquid by a continual progressive squeezing operation in the liquid discharging direction;

said first housing section having a front end wall, said front end wall having an outlet opening extending completely therethrough so as to communicate with said first internal chamber, said bladder being integrally provided with an outlet tube located in and completely filling said outlet opening and having an outer end captured by said front end wall, said outlet valve assembly comprising a manually operable knob rotatably mounted on said first housing section and having an end portion protruding laterally into said outlet opening and bearing against said outlet tube for manually selectively closing said tube by lateral restriction thereof and adjustably opening said tube for selective discharge of said fluid;

said front end wall having an inlet opening extending completely therethrough so as to communicate with said first internal chamber, said bladder being integrally provided with a flexible walled inlet conduit located in and completely filling said inlet opening and having an outer end captured by said front end wall, a plug removably insertable into said conduit and oversize with respect to said conduit so as to tightly press said flexibly walled conduit against said first housing section to seal said bladder against fluid leakage.

* * * * *